United States Patent [19]

Baatz

[11] Patent Number: 4,674,742

[45] Date of Patent: Jun. 23, 1987

[54] WIND LOAD SIMULATOR FOR BICYCLE

[75] Inventor: Wilfried Baatz, Bellevue, Wash.

[73] Assignee: Racer-Mate, Inc., Seattle, Wash.

[21] Appl. No.: 759,670

[22] Filed: Jul. 29, 1985

[51] Int. Cl.[4] ..... A63B 21/00

[52] U.S. Cl. ..... 272/73

[58] Field of Search ..... 272/73; D21/194

[56] References Cited

U.S. PATENT DOCUMENTS

| | | | |
|---|---|---|---|
| 351,311 | 10/1886 | Conkling . | |
| 418,933 | 1/1890 | Sommerville . | |
| 574,167 | 12/1896 | Ray | 272/73 |
| 645,482 | 3/1900 | Mills . | |
| 2,788,211 | 4/1957 | Ivanoff | 272/73 |
| 4,082,264 | 4/1978 | Santos | 272/73 |
| 4,505,473 | 3/1985 | Pro | 272/73 |

OTHER PUBLICATIONS

"Racer Mate", ad-Bicycling Magazine, p. 100, Jan.-/Feb. 1982.

Advertisement from Mar. 1978 issue of *Bicycle Journal*, for bicycle accessories by JCI Bicycle Products, Industry, California.

Advertisement from Mar. 1978 issue of *Bicycle Journal* for Bike Exercise Convertor by Troxel Manufacturing Co., Moscow, Tenn.

German article for Home Trainer F.T.G.

Racer-Mate Wind Load Simulator, Jul. 1978.

Racer-Mate III, Jul. 1984.

Supra Trainer by Racer-Mate, Aug. 1985.

*Primary Examiner*—Richard J. Apley

*Assistant Examiner*—S. R. Crow

*Attorney, Agent, or Firm*—Christensen, O'Connor, Johnson & Kindness

[57] ABSTRACT

A training device for a bicycle comprising a frame (22) for supporting the bicycle in an upright position, mounting means (32,34) for securing the frame to the bicycle adjacent the bicycle's rear axle, and wind load simulation means (120). The frame includes a base (24), a pair of spaced-apart side members (26,28) and an upper support (50). The side members extend upwardly from the base on opposite sides of the rear wheel of the bicycle. The upper support is connected to side members, and is adapted to abut the rear brake (14) of the bicycle. The wind load simulation means includes a shaft (126), fan means (122,124) mounted to the shaft, and means (142,140,128) for mounting the shaft such that the shaft is rotatable about a shaft axis parallel to the rear axle. The shaft is movable into a position (172) in which the shaft frictionally engages the rear wheel for rotation therewith. The means for mounting the shaft may comprise spring means (144) for biasing the shaft towards the rear wheel.

9 Claims, 8 Drawing Figures

WIND LOAD SIMULATOR FOR BICYCLE

FIELD OF THE INVENTION

The present invention relates to an in-place exercise device or trainer for a bicycle. In particular, the present invention relates to an in-place bicycle trainer that functions as a wind load simulator.

BACKGROUND OF THE INVENTION

Two general types of bicycle trainers are known in the prior art. In one type, the rear wheel of a two-wheeled bicycle is supported on one or more rollers. As a user pedals, the rear wheel rotates, thereby causing the rollers to rotate. While the rolling friction of the bicycle tire against the roller may simulate the actual rolling resistance that a rider would have to overcome if he or she was pedaling the bicycle at the same speed on a level road, wind resistance is not simulated. The horsepower that a bicyclist must generate through the bicycle pedals to overcome wind resistance increases as a cubic function of the rotational speed of the tires. However, the horsepower needed to overcome rolling resistance increases linearly with an increase of the rotational speed of the tires. Therefore, at higher speed, wind resistance becomes the dominating factor that the bicycle rider must overcome in actual riding conditions.

To overcome the limitations of "roller" type trainers, a second type of bicycle training devices has achieved widespread use during the past several years. This newer class of trainers, termed wind load simulators, include a fan assembly in rotational contact with the rear wheel of the bicycle. The fan assembly rotates with the rear wheel, and generates a load that is essentially identical to the load that would be produced by wind resistance if the pedalist were actually riding the bike at a speed corresponding to the rear wheel rotational speed. The best known type of prior wind load simulator includes means for gripping the frame of a bicycle, and a roller/fan assembly positioned beneath the rear wheel of the bicycle, such that the roller/fan assembly is frictionally engaged by the rear wheel. A second known wind load simulator includes means for supporting the bicycle by gripping the frame, and a roller/fan assembly mounted on an arm that in turn is pivotally connected to the bicycle above the rear wheel adjacent the seat, such that the arm can pivot downward until the roller/fan assembly contacts the rear tire.

Although wind load simulators represent a significant breakthrough in bicycle training devices, existing wind load simulator designs have a number of limitations. All types of wind load simulator must grip and support the bicycle such that the bicycle is stable and the rear wheel is suspended above the support surface. In prior devices, the support system has required at least one member that engages the bicycle on one of its painted surfaces, an approach that invariably leads to scratching of the paint and possible damage to the thin tubular frame. A second drawback of existing wind load simulators relates to vibration. In prior simulators, vibration generated by rotation of the fan/roller assembly is directly transmitted to the support surface (i.e., the floor), resulting in low frequency vibrations that can be readily transmitted through floors and walls of a building. This feature places severe constraints on the use of wind load simulators in apartments or similar dwellings. A third limitation of prior wind load simulators is that they have been comparatively bulky devices, not adapted to compact storage and/or transportation.

SUMMARY OF THE INVENTION

The present invention provides a bicycle training device that includes a wind load simulator and that overcomes many of the limitations of prior wind load simulation training devices. The training device of the present invention is capable of supporting the bicycle without contacting any painted surfaces, and further provides improved vibration isolation between the training device and the underlying support surface.

In one embodiment, the training device comprises a frame for supporting the bicycle in an upright position, mounting means for securing the frame to the bicycle adjacent the bicycle's rear axle, and wind load simulation means. The frame includes a base portion, a pair of spaced apart side members, and an upper support. The side members extend upwardly from the base portion on opposite sides of the rear wheel of the bicycle. The upper support is connected to the side members, and is adapted to contact a portion of the bicycle above the rear axle. The mounting means secures the side members to the bicycle such that the rear wheel can be rotated in place. The wind load simulation means includes a shaft, fan means mounted to the shaft, and means for mounting the shaft such that the shaft is rotatable about a shaft axis parallel to the rear axle. The shaft is movable into a position in which the shaft frictionally engages the rear wheel for rotation therewith.

In a preferred embodiment, the upper support comprises an abutment member adapted to abut the rear brake of the bicycle. The frame is configured such that when the abutment member abuts the rear brake, the side members extend upward and forward through the mounting means to the abutment member, such that the weight of the bicycle tends to drive the abutment member forward into the rear brake. In such an embodiment, the mounting means preferably contacts the bicycle at each end of the rear axle, such that the training device contacts the bicycle only at the rear wheel, the rear axle, and the rear brake, thereby supporting the bicycle without contacting any painted surfaces.

In a further preferred embodiment, the means for mounting the shaft comprises hinge means for mounting the shaft for rotation about the shaft axis that is fixed with respect to the hinge means, and bracket means for pivotally mounting the hinge means to the frame. The hinge means is rotatable about a hinge axis that is fixed with respect to the frame and parallel to the rear axle. The hinge means, shaft and fan means are rotatable in unison about the hinge axis between a first position in which the shaft contacts the rear wheel and a second position in which the shaft is not in contact with the rear wheel. The bracket means may comprise spring means for biasing the shaft toward the rear wheel when the shaft is in its first position.

DETAILED DESCRIPTION OF THE INVENTION

Figure 1:
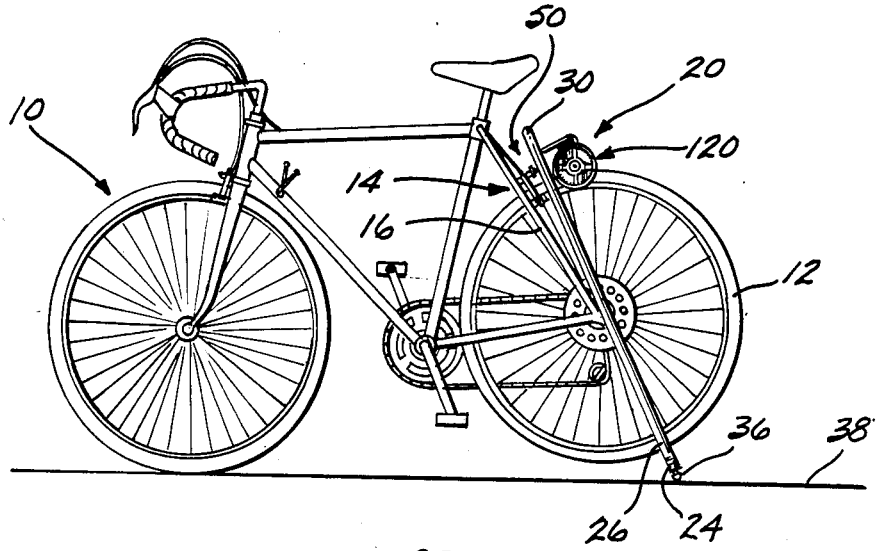
FIG. 1 is a side elevational view of a preferred embodiment of the training device of the present invention in use with a conventional bicycle.
Figure 2:
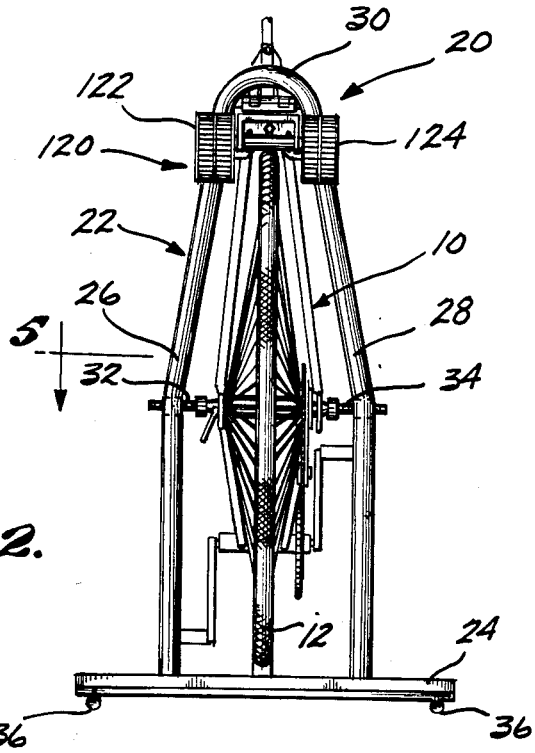
FIG. 2 is a rear elevational view of the training device of FIG. 1.

FIGS. 1 and 2 illustrate a preferred embodiment of training device 20 for use with conventional bicycle 10. The training device comprises frame 22, axle supports 32 and 34, upper support assembly 50 and fan assembly 120. Frame 22 includes base 24 and side members 26 and 28 that have their upper ends interconnected by cross member 30. The side members extend in generally parallel fashion upwardly from the base, and are spaced apart such that rear wheel 12 of bicycle 10 can be positioned between the side members. In a preferred embodiment, side members 26 and 28 and cross member 30 are fabricated from a single continuous piece of metallic tubing. Base 24 contacts the underlying support surface 38 through rubber feet 36 that protect the support surface from being scratched or otherwise damaged by the training device. Axle mounts 32 and 34 are secured to side members 26 and 28 respectively, and serve to pivotally mount the rear axle of rear wheel 12 to frame 22. The axle mounts are described in greater detail below.

Upper support assembly 50 is mounted to the upper portion of frame 22 just below cross member 30. Upper support assembly 50 operates by providing an abutment between training device 20 and rear brake 14 of the bicycle. Such abutment prevents rotation of the training device in a counterclockwise direction beyond the position shown in FIG. 1. This abutment, coupled with the pivotal mount provided by axle mounts 32 and 34, provides a secure and stable mounting for the bicycle. The weight of the bicycle and pedalist tends to cause the training device to rotate counterclockwise (FIG. 1), thereby driving upper support assembly 50 more firmly into contact with rear brake 14. As described in greater detail below, this mounting arrangement possesses the unique advantage that there is no contact between the bicycle training device and a painted surface of the bicycle.

Figure 3:
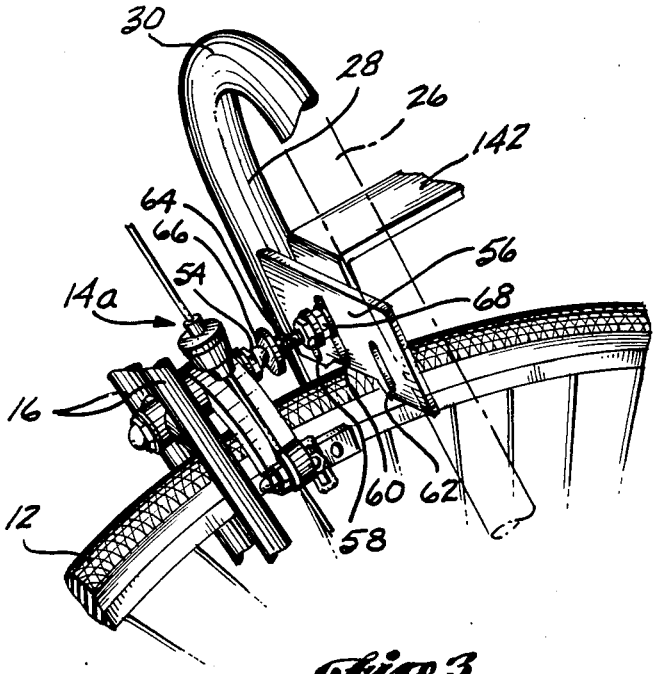
FIG. 3 is a perspective view of the upper support assembly for a side pull brake.

FIG. 3 illustrates the upper support assembly for bicycles in which the rear brake is of the side pull-type, as illustrated by brake 14*a* in FIG. 3. Brake 14*a* is mounted to bicycle frame members 16 that extend downwardly from the vicinity of the bicycle seat post to the rear axle on either side of rear wheel 12. Brake 14*a* includes a central shaft that terminates in rounded hub 54. A preferred upper support assembly for such a brake comprises plate 56 that extends between the upper portions of side members 26 and 28. Plate 56 includes longitudinal slot 60, and may also include longitudinal slots 58 and 62 for the purpose described below. Abutment member 64 is secured in slot 60 by nuts 68 and by an additional nut, described below, on the opposite side of plate 56. The abutment member extends forwardly from plate 56 toward brake 14*a*, and terminates in circular plate 66 that includes a flat, forward facing surface adapted to abut hub 54. The position of abutment member 64 can be adjusted towards and away from rear wheel 12 by loosening nuts 68, sliding abutment member 64 upwards or downwards in slot 60, and then retightening the nuts.

Figure 4:
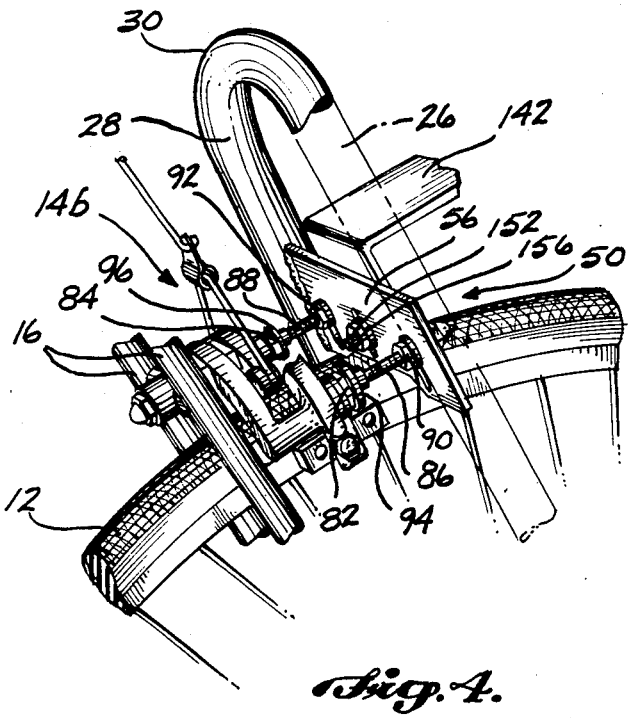
FIG. 4 is a perspective view of the upper support assembly for a center pull brake.

FIG. 4 illustrates the upper support assembly for a bicycle having center pull brake 14*b*. Brake 14*b* is secured to frame members 16, and includes a pair of laterally positioned bolt heads 82, 84 positioned on either side of rear wheel 12. A preferred upper support assembly for such a brake comprises a pair of abutment members 86 and 88 that extend forwardly from plate 56 and that are secured in slots 58 and 62, respectively, by nuts 90 and 92. Abutment members 86 and 88 terminate in plates 94 and 96 respectively, the plates being adapted to abut bolt heads 82 and 84. As with the embodiment of FIG. 3, abutment members 86 and 88 can be adjusted upward and downward in their slots by loosening bolts 90 and 92, respectively.

Figure 5:
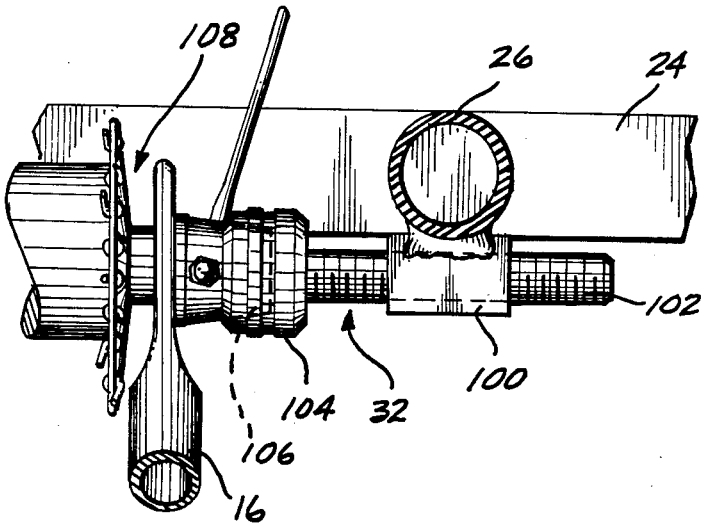
FIG. 5 is a top plan view of one of the axle mounts.

Referring now to FIG. 5, axle mount 32 includes internally threaded collar 100 that is welded or otherwise secured to the forward side of side member 26. Shaft 102 is threadably engaged in collar 100, and includes cup 104 that is mounted on the inward end of the shaft. Cup 104 is shaped to fit over hub 106 of bicycle axle assembly 108. Axle mount 36 is the mirror image of axle mount 32. To mount the axle of rear wheel 12 to training device 20, shaft 102 (and/or the corresponding shaft of axle mount 34) is rotated such that the shaft moves outward, to the right in FIG. 5, until cup 104 can be aligned with hub 106. Shaft 102 is then rotated in the opposite direction, until the bicycle axle assembly is securely mounted between axle mounts 32 and 34. The position of axle mounts 32 and 34 on side members 26 and 28 is selected such that when the bicycle axle is mounted between the axle mounts, the rear wheel of the bicycle is suspended above support surface 38. Other configurations for axle mounts 32 and 34 could be used to accommodate various bicycle designs. All axle mounting systems preferably permit rotational movement of frame 22 with respect to the bicycle, to provide secure abutment between upper support assembly 50 and rear brake 14.

Figure 6:
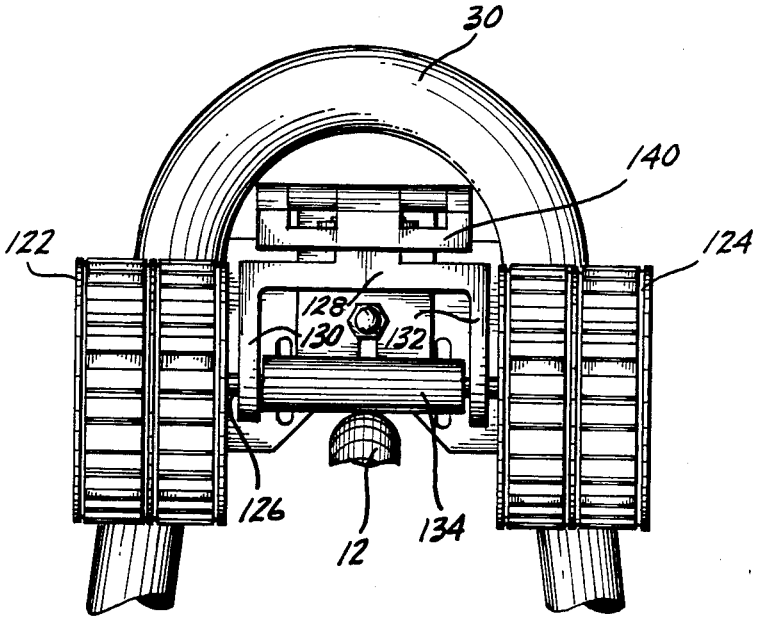
FIG. 6 is a rear elevational view of the fan assembly.
Figure 7:
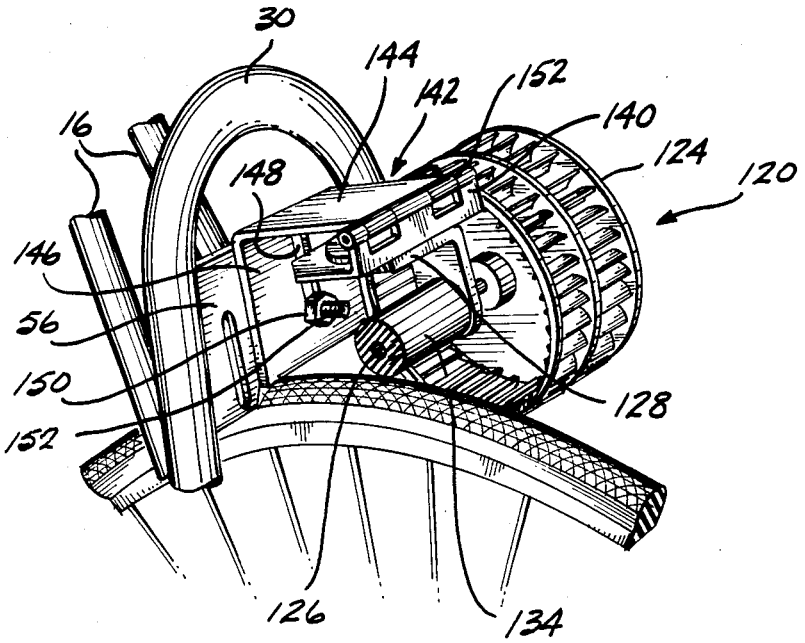
FIG. 7 is a partially cut-away perspective view of the fan assembly.
Figure 8:
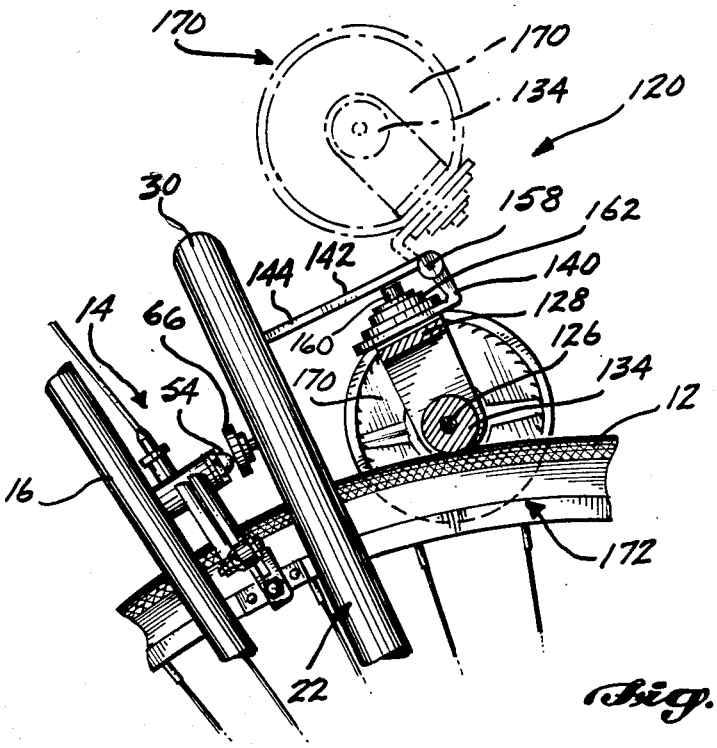
FIG. 8 is a side elevational view of the fan assembly.

Referring now to FIGS. 6–8, fan assembly 120 is mounted to the upper portion of frame 22, and provides wind load simulation for training device 20. The fan assembly comprises conventional blower fans 122 and 124 secured to opposite ends of shaft 126. Shaft 126 is mounted by U-shaped bracket 128 that includes depending mounting flanges 130 and 132, mounting flanges 130 and 132 including openings through which shaft 126 passes. Roller 134 is press-fit or otherwise secured on shaft 126 between mounting flanges 130 and 132, and is adapted to frictionally engage rear wheel 12 to cause shaft 126 and fans 122 and 124 to rotate with the rear wheel as described below.

Bracket 128 is bolted to hinge member 140 that is in turn pivotally mounted to bracket 142. Bracket 142 has a right angle configuration that includes upper section 144 and forward section 146. Forward section 146 includes slot 148. Forward section 146 of bracket 142 is secured to plate 56 by nut 150 and bolt 152 that extends through slot 148 and through slot 60 of plate 56. For the side pull brake configuration shown in FIG. 3, bolt 152 comprises the rearward end of abutment member 66. For the center pull brake arrangement shown in FIG. 4, bolt 152 is secured at the forward side of plate 56 by nut 156. Slots 60 and 148 permit upward or downward adjustment of the position of bracket 142 with respect to plate 56, as described more fully below. Hinge member 140 is pivotally mounted to the rearward edge of upper section 144 of bracket 142 at hinge axis 158 such that hinge member 140 can rotate, together with mounting bracket 128 and fan wheels 122 and 124, through the range of positions indicated in FIG. 8. Bracket 128 is secured to hinge member 140 by one or more bolts 160 that pass through openings (not shown) in bracket 128 and in hinge member 140. Mounted on the opposite side of hinge member 140 are washers 162 that may be used to control the distance that bolts 160 extend from the hinge member. As illustrated in FIG. 8, bolts 160 act as stops that abut upper section 144, and prevent further clockwise rotation of hinge member 140 about hinge axis 158.

FIG. 8 illustrates fan assembly 120 in a first position 170 in which the fan assembly is swung upward away from rear wheel 12, and in a second position 172 in which roller 134 contacts the outer circumference of the rear wheel. The fan assembly is constructed and adjusted such that bolt 160 contacts upper section 144 when shaft 126 is slightly over center (leftward in FIG. 8) with respect to a line drawn between hinge axis 158 and the axis of rotation of rear wheel 12. To use the training device, the bicycle is first mounted between axle supports 32 and 34, as indicated in FIG. 1. Fan assembly 120 is then rotated from position 170 clockwise until roller 134 just contacts the outer circumference of rear wheel 12. At this point, shaft 126 is slightly to the right of the line between hinge axis 158 and the axis of rotation of the rear wheel. However, as soon as a user begins pedaling the bicycle, the rotation of rear wheel 12 forces shaft 126 over center until bolt 160 contacts upper section 144. This arrangement has the advantage of providing a consistent and predictable frictional engagement between roller 134 and the rear wheel when the training device is in use. It is therefore an easy manner to adjust such frictional contact to avoid slippage at a predetermined speed.

A further advantage of the arrangement indicated in FIG. 8 is that upper section 144 acts as a leaf spring to maintain good contact between roller 134 and rear wheel 12, and in addition to provide vibration isolation between the fan assembly and frame 22. As is well known, operation of a conventional bicycle training device typically transmits significant vibrations into the floor or other support surface on which the training device is used. The low frequency components of such vibrations are readily transmitted through floors and walls, resulting in limited utility of conventional bicycle training devices in apartments and the like. In the training device of the present invention, the spring action of upper section 144 significantly attenuates such low frequency vibrations, with the result that the low frequency vibration transmitted to frame 22 and to the underlying support service are greatly minimized. The bias force supplied to upper section 144 when the fan assembly is in position 172 is a function of the height at which bracket 142 has been adjusted above the rear wheel. The slightly over center position of shaft 126 therefore also contributes to the control and predictability of the vibration isolation provided by the bicycle training device.

While the preferred embodiments of the invention have been illustrated and described, it should be understood that variations will be apparent to those skilled in the art. Accordingly, the invention is not to be limited to the specific embodiments illustrated and described, and the true scope and spirit of the invention are to be determined with reference to the following claims.

The embodiments of the invention in which an exclusive property or privilege is claimed are defined as follows:

1. A training device for use with a bicycle having a rear wheel rotatably mounted on a rear axle and brake means mounted adjacent the rear wheel above the rear axle, the training device comprising:

a frame for supporting the bicycle in an upright position, the frame including a base portion, a pair of spaced apart side members that in use extend upwardly and forwardly from the base portion on opposite sides of the rear wheel, and an upper support connected to the side members, the upper support including an abutment member adapted to abut the brake means;

mounting means for securing the side members to the bicycle adjacent the rear axle such that the rear wheel can be rotated in place;

wind load simulation means including a shaft, fan means mounted to the shaft, and means for mounting the shaft such that the shaft is rotatable about a shaft axis parallel to the rear axle and movable into a position in which the shaft frictionally engages the rear wheel for rotation therewith; and the frame being configured such that when the abutment member abuts the brake means, the side members extend upward and forward through the mounting means to the abutment member, such that the weight of the bicycle tends to drive the abutment member forward into the brake means.

2. The training device of claim 1, wherein the mounting means contacts the bicycle at each end of the rear axle.

3. The training device of claim 1, wherein the training device contacts the bicycle only at the rear wheel, at the rear axle and at the brake means.

4. The training device of claim 1, wherein the means for mounting the shaft comprises means for moving the shaft with respect to the bicycle and frame between a first position in contact with the rear wheel and a second position out of contact with the rear wheel.

5. The training device of claim 4, wherein the means for mounting the shaft comprises spring means for biasing the shaft towards the rear wheel when the shaft is in its first position.

6. The training device of claim 1, wherein the lowermost portion of the base comprises a single cross member that is coplanar with the side members and parallel to the rear axle of the bicycle, such that the rear portion of the bicycle is supported entirely through said cross member when the training device is in use.

7. A training device for use with a bicycle having a rear wheel rotatably mounted on a rear axle, the training device comprising:

a frame for supporting the bicycle in an upright position, the frame including a base portion, a pair of spaced apart side members that in use extend upwardly from the base portion on opposite sides of the rear wheel, and an upper support connected to the side members and adapted to contact a portion of the bicycle above the rear axle;

mounting means for securing the side members to the bicycle adjacent the rear axle such that the rear wheel can be rotated in place; and wind load simulation means including a shaft, fan means mounted to the shaft hinge means for mounting the shaft for rotation about a shaft axis that is fixed with respect to the hinge means and parallel to the rear axle, and bracket means for pivotally mounting the hinge means to the frame such that the hinge means is rotatable about a hinge axis that is positioned above the rear wheel and parallel to the rear axle, the hinge means, shaft and fan means being rotatable in unison about the hinge axis between a first position in which the shaft contacts the rear wheel and a second position in which the shaft is not in contact with the rear wheel.

8. The training device of claim 7, wherein the bracket means includes spring means for biasing the shaft toward the rear wheel when the shaft is in its first position.

9. The training device of claim 7, wherein when the shaft is in its first position, the shaft is slightly over center with respect to a line between the hinge axis and the rear axle.

* * * * *